United States Patent [19]

McBurnett et al.

[11] 4,266,915

[45] May 12, 1981

[54] GEAR PUMPS AND MOTORS

[75] Inventors: James R. McBurnett; James M. Eley, both of Corinth, Miss.

[73] Assignee: Tyrone Hydraulics Inc., Corinth, Miss.

[21] Appl. No.: 29,891

[22] Filed: Apr. 13, 1979

Related U.S. Application Data

[63] Continuation-in-part of Ser. No. 923,094, Jul. 10, 1978, abandoned.

[51] Int. Cl.[3] ..... F04C 15/00

[52] U.S. Cl. ..... 418/126

[58] Field of Search ..... 418/74, 125, 126, 129

[56] References Cited

U.S. PATENT DOCUMENTS

| | | | |
|---|---|---|---|
| 2,742,862 | 4/1956 | Banker | 418/126 |
| 2,996,999 | 8/1961 | Trautman | 418/126 |
| 3,437,048 | 4/1969 | Noell et al. | 418/129 X |
| 3,915,604 | 10/1975 | Kitta et al. | 418/126 X |
| 3,986,800 | 10/1976 | Dworak et al. | 418/126 X |

FOREIGN PATENT DOCUMENTS

| | | | |
|---|---|---|---|
| 2604969 | 8/1977 | Fed. Rep. of Germany | 418/126 |

*Primary Examiner*—Leonard E. Smith

*Attorney, Agent, or Firm*—Charles H. Lindrooth

[57] ABSTRACT

The disclosure relates to improvements in pumps and motors of the gear type. The gear elements are arranged within the pump or motor housing so that the ends or the tips of the teeth are spaced out of fluid sealing relationship and not pressed into the surrounding chamber wall on the low pressure side of the housing. According to the disclosure, sealing members of limited circumferential extent are provided in the housing at the high pressure side of the gears for the purpose of providing a fluid seal between the tips of the teeth in a limited region adjacent the opening in the housing which is at higher pressure. The sealing members disclosed are a pair of separate shoes located adjacent the high pressure opening. The sole support for the shoes is provided by the side pressure plates.

8 Claims, 4 Drawing Figures

14
14b
16
16
22
10a
10
20
29
12
26
19
23
21
15
25a
25
23
27
24
26
13
29
22
11a
11
16
16

GEAR PUMPS AND MOTORS

RELATED APPLICATIONS

This application is a continuation-in-part of our copending application Ser. No. 923,094, filed July 10, 1978, now abandoned.

FIELD OF THE INVENTION

The invention relates to improvements in hydraulic equipment such as gear pumps and motors, which improvements provide for a reduction in the bearing loads and in the stresses imposed on vital parts, thereby resulting in increased durability, prolonged life and increases in operating efficiency.

BACKGROUND OF THE INVENTION

As is generally recognized by those of ordinary skill in the art, hydraulic pumps and motors of the gear type have found widespread use in heavy equipment and in various other implements wherein loads several times larger than were contemplated only a few years ago are involved. Obviously, this leads to much larger stresses being imposed on vital parts in the pump or motor which in turn increases the possibility of failure of an overloaded part. Usually when a failure occurs under conditions of actual use, it occurs with little warning so that a major breakdown of the equipment may occur when the equipment is in the field and repair parts and facilities are unavailable. It is recognized in the design of conventional gear pumps and motors that the severe load imposed on the bearings because of the substantial pressure differential which exists between the inlet and the outlet side when a pump or motor is under load is a frequent cause of failure. In modern hydraulic equipment a pressure differential of several thousand p.s.i. may exist across the gears. In a conventional gear pump, this pressure differential forces the gears and the side sealing plates against the interior wall portions of the housing on the inlet side, that is, the low pressure side of the gears. In fact, it has become accepted practice in the manufacture of gear pumps and motors to design the parts with the expectation that during the course of a breakin period, the housing wall on the low pressure side of the gears is gradually machined by a cutting and wearing action of the gear teeth to a matching configuration. Sometimes, the action of the teeth as cutters causes a tearing out of pieces of the housing at points where minor imperfections in the casting are present causing a destruction of the pump. Even if the pump housing is not damaged during break-in, as the pump is used, the machined region of the housing will continue to be gradually worn away. The inevitable result is a progressive loss in efficiency due to a less perfect seal between the teeth and housing interior, or a failure of some critical part. Although these problems can be alleviated by careful manufacturing and inspection procedures, and by selection of proper materials and the use of ample safety factors, the problems described constitute an inherent limitation to presently existing designs.

SUMMARY AND OBJECTS OF THE INVENTION

The present invention is concerned with pumps and motors of the general kind above referred to and has as a major object, the incorporation of design features which reduce the effects of the differential pressure acting on gear-type pump or motor elements and which eliminate or substantially reduce pump and motor failures attributable to the pressure differential acting on the gear elements.

Another object of the invention is the reduction of wear and prolongation of life of gear pumps and motors.

A further objective of the invention is the provision of means in a gear pump of given size, for increasing the volume of the pump inlet chamber and hence the efficiency as compared with prior designs.

Still another objective of the invention is the reduction of the stresses to which castings, bearings and other parts of gear pumps and motors are subjected without sacrificing the performance characteristics of the pump or motor.

A further objective of the invention is the provision of design features which eliminate or substantially reduce the break-in period required with prior gear pump and motor designs.

A still further objective of the invention is the provision of a gear pump and motor design which permits operation with zero or oil film tolerances at the tooth tips thereby reducing leakage, and eliminating any tendency of the teeth to wear and to produce chips of housing material when under load.

Another object of the invention is to reduce the effect of increased temperature when using dissimilar metals for housing and gears (i.e. aluminum housing, steel gears).

Another object of the invention is the reduction of the effects of operating with particulate contaminated fluid by reducing the effective sealing lengths and therefore reducing the area exposed to contaminated fluid under pressure.

A further objective of the invention is the provision of an economical high performance gear pump in which the radial pressure sealing members can be made of materials which are highly resistant to erosion without appreciably increasing pump costs.

A still further objective of the invention is the provision of a gear pump which is simpler and more economical to repair than prior designs.

Another object of the invention is the provision of a gear pump wherein little or no contamination is generated in the event of bearing failure.

In summary, the foregoing objects of the invention are achieved by the provision in a gear pump of sealing shoes which are loaded toward the gear teeth by the discharge pressure. The gears track into these sealing shoes to provide minimum tip clearance. The shoes are replaceable and since they are not pressure vessels may be made of various materials such as materials which are highly resistant to erosion thereby increasing the useful range of operating pressures for which the pumps may be utilized. The same shoes are provided at the high pressure inlet of a motor, in a gear motor configuration.

Other objects and advantages of the invention will become apparent upon reference to the following description of a preferred embodiment of the invention.

DETAILED DESCRIPTION OF THE INVENTION

Figure 1:
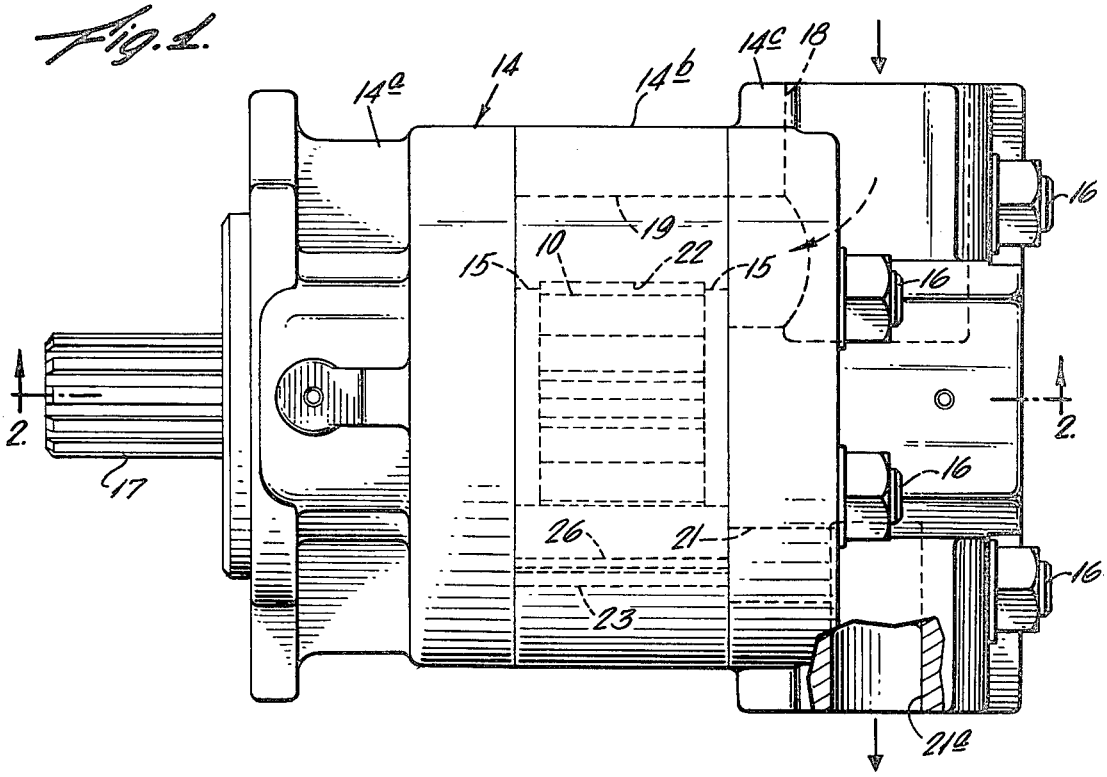
FIG. 1 is an exterior view of a typical hydraulic gear pump incorporating the principles of the present invention with portions of the housing broken away for purposes of illustration.
Figure 2:
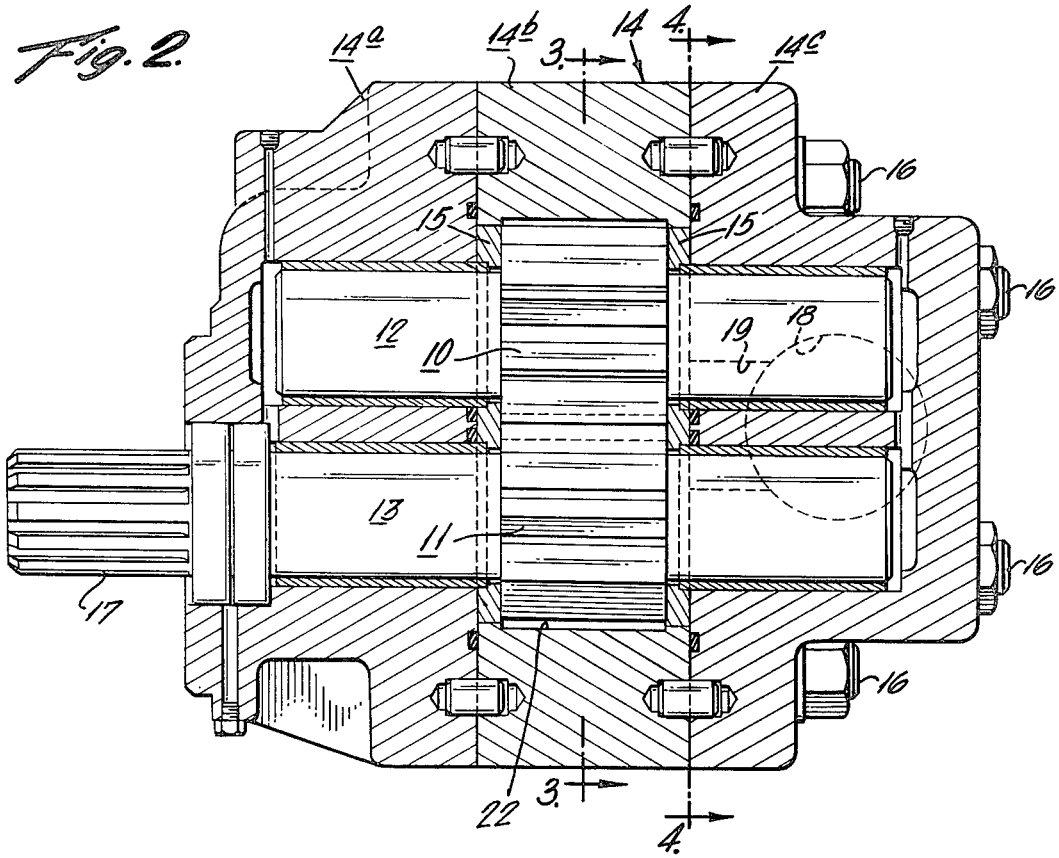
FIG. 2 is a sectional view taken along line 2—2 of FIG. 1.
Figure 3:
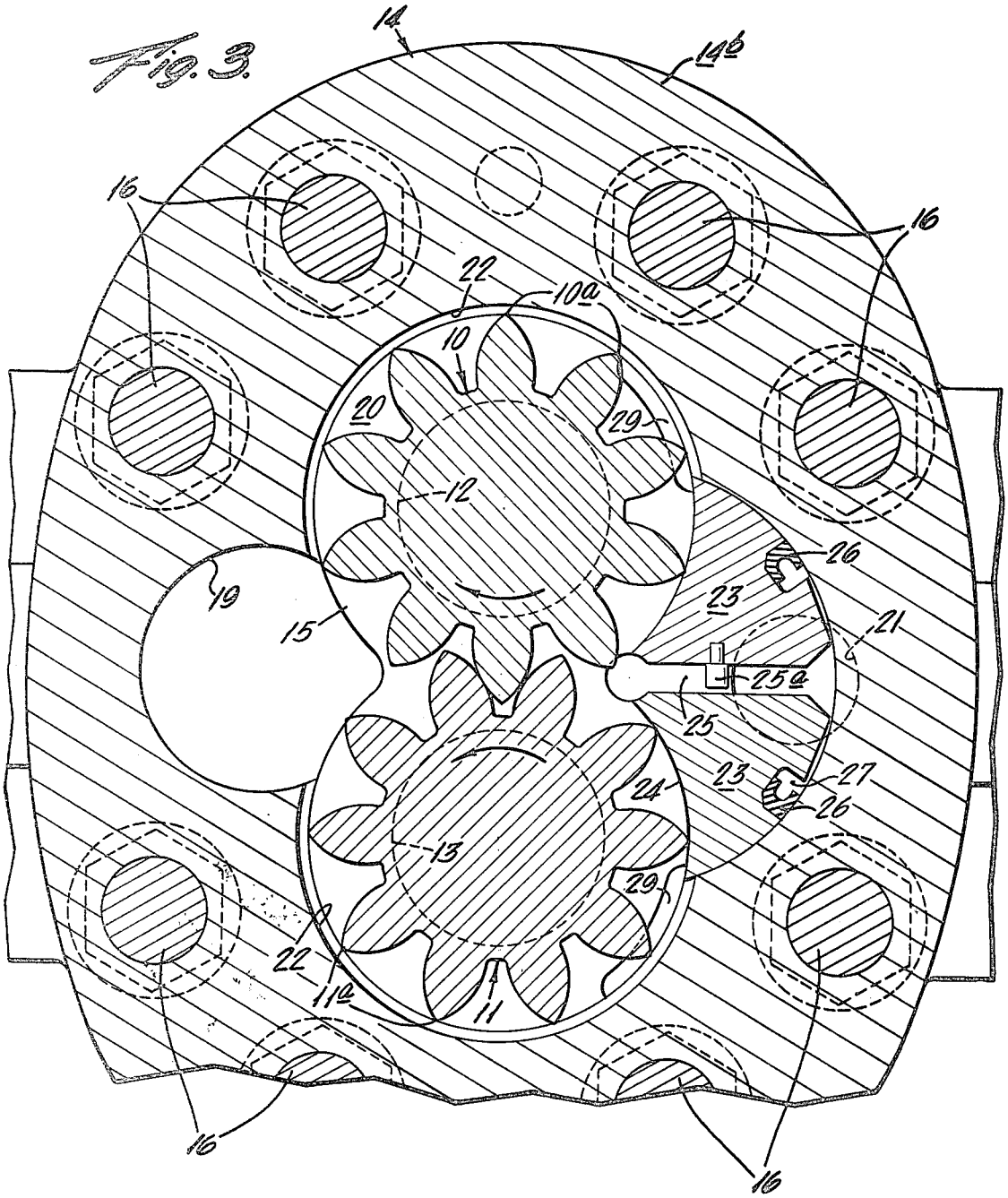
FIG. 3 is a sectional view taken along line 3—3 of FIG. 2.

Reference is made to the drawings, especially FIGS. 1 and 3, wherein the invention is shown as embodied in a typical gear pump in which a pair of gears 10 and 11 are provided as pumping elements for pumping hydraulic fluid from a reservoir to a hydraulically operated device, not shown. Gears 10 and 11 are mounted on parallel shafts 12 and 13, best shown in FIG. 2, and journalled in sleeve-type bearings within a housing 14. Floating side pressure plates 15 of conventional construction, are provided on both sides of the rotating gears. The housing 14 is typically split into two or more components, a three piece housing being illustrated. The three pieces, identified by the reference characters 14*a*, 14*b*, and 14*c*, are secured together by suitable means such as bolts 16.

As can be best seen in FIG. 1, shaft 13 projects outside of the housing 14 and is provided with a drive connection such as a spur gear 17 which comprises a drive means which also includes a motor, not shown.

An inlet line represented at 18 in FIG. 1 leads to an inlet opening 19 which in turn leads to the hollow housing chamber 20 within which the gears are located as best illustrated in FIG. 3. The chamber has an outlet 21 located on the opposite side of gears 10 and 11 from the inlet 19. An outlet passage 21*a* leads to the hydraulically operated equipment, not shown.

As is best shown in FIG. 3, the interior of the housing is formed so that there is a substantial clearance space between the tips of the gear teeth at the addendum circle as shown at 10*a* and 11*a*, and the inner periphery of the housing wall as shown at 22. This clearance space runs from the inlet region 19 circumferentially of each gear to a point at which radial sealing means are located adjacent the outlet 21. According to the invention, the distance between the teeth tips and the wall 22 on the low pressure side of the gears is such that under all anticipated load conditions the teeth do not contact the wall.

In carrying out the invention, the sealing means preferably comprise shoes 23 which are separated for independent positioning adjacent each side of the outlet. Preferably the shoes 23 float within a semicircular recess machined into the housing 14*b* so as to extend across the entire face of the gears. The shoes extend at each end beyond the inner borders of the pressure plates and are dimensioned so that the pressure plates provide the sole support for the shoes which float within the semicircular recess. As can best be seen in FIG. 3 each is provided with a curved surface 24 whose radius is equal to the radius of the curved edge surfaces of the pressure plates.

Figure 4:
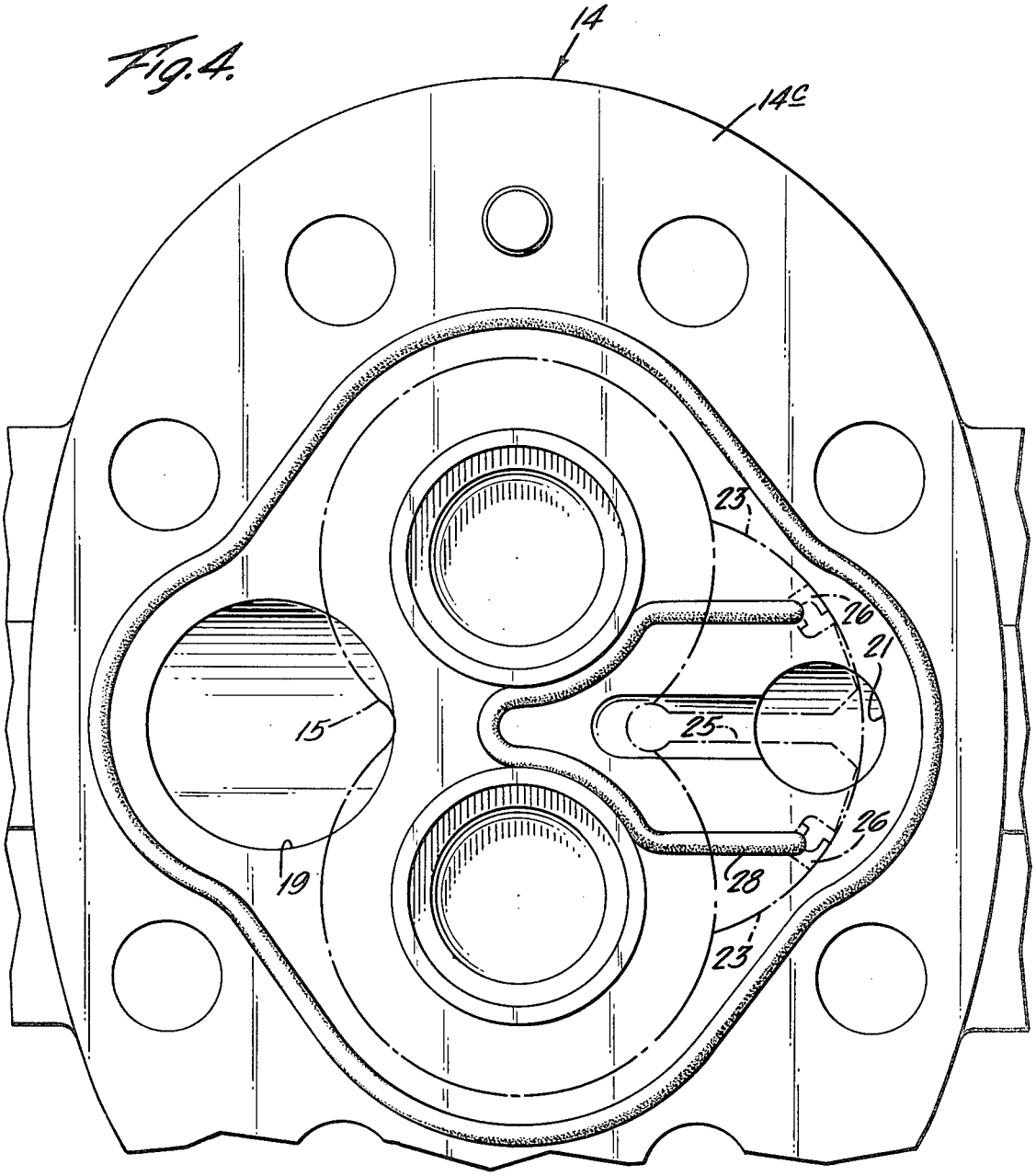
FIG. 4 is a sectional view taken on lines 4—4 of FIG. 2.

When mounted within the recess the shoes are separated by a space 25 which provides for communication between the gears and the discharge opening 21. Preferably, a pin 25*a* is mounted within one of the shoes and extends towards the opposite shoe so as to maintain the shoes in proper position when the pump is not operating. When the pump is operating a slight clearance is maintained between the bottom of the pin and the adjacent surface of the other shoe. In order to confine and limit the extent to which the discharge pressure is applied to the shoes, the back of each shoe is provided with a flexible sealing member 26 which is mounted in a recess 27 extending lengthwise of the shoes. The ends of this sealing member overlap the ends of sealing members 28 which fit within grooves in side sections of the housing 14*a* and 14*c*, one of which is shown in FIG. 4 to define sealed pressure regions behind the shoes. It can be seen from FIG. 3 that the discharge pressure is communicated to this region behind the shoes as limited by the seals 26 and 28 and acts to press the shoes against the edges of the side plates and into sealing relationship with the tips of the teeth. Preferably, the shoes are dimensioned when initially made so that when the pump is finally assembled, the gears track into the shoes slightly, cutting their final clearance, and thus assuring a good seal between the teeth and the shoes.

Preferably the side plates have chamfered portions 29 which are located adjacent to and in position so that they slightly overlap the shoes. These portions serve to provide a more gradual or less abrupt build-up of pressure as the teeth pass into sealing relationship with the shoes.

As should be evident from the above, the function of the shoes is to provide a fluid seal with the tips of those teeth 10*a* and 11*a* in the limited region immediately adjacent the high pressure side of the gears, which in the case of the pump is the outlet 21. As is shown in FIG. 3, these sealing shoes subdivide the interior of the housing into a relatively large inlet chamber portion which extends from inlet port 19 to the point where the teeth tips engage the surface of a shoe 23 wherein the fluid pressure is substantially zero and a relatively small outlet chamber portion wherein the pressure is the full discharge pressure.

Although the sealing surface of the shoes 23 can be made longer than is shown in FIG. 3, the preferred length of the sealing surface of each shoe is such that the tips of no more than two teeth at any given time are in full sealing relationship with the sealing surface of the shoes. In operation, this means that the full discharge pressure is limited in its application to the area of those teeth immediately adjacent the outlet. This pressure acts to push the shoes apart as viewed in FIG. 3 and also acts against the backs of the shoes within the limits of the space defined by seals 26. The net effect is to press the shoes into sealing relationship with the teeth. It should be noted that the fluid pressure in the cavity between any two teeth in sealing relationship with the elements 23 is at an intermediate value somewhat below the discharge pressure whereas the remainder of the cavity 20 which encompasses over two-thirds of the circumference of the gears is at low pressure.

A wide choice of materials which would be impractical to select as material for the entire housing is available for the shoes. For example, materials having high abrasion and erosion resistance can be employed. An important factor which causes deterioration of conventional gear pumps and motors under severe pressure and temperature conditions is erosion across the tips of the teeth. Erosion resistant materials such as hard bronze or steel which would be unsuitable or too expensive for entire housings can be chosen for use as shoe materials. Such materials show no appreciable increase in deterioration from erosion at pressures between 3000 and 4000 p.s.i., substantially increasing the range of usefulness of the pumps.

In summary, the construction shown in FIGS. 1-4 effects a reduction in the unit load on the bearings by a substantial reduction in the area of the gears exposed to the discharge pressure. In turn, the loading on other pump parts is correspondingly reduced. The use of sealing shoes adjacent the high pressure side of the pump or motor allows for a zero or oil film clearance with the tips of the teeth. Since the gears are not pressed into contact with the housing, the break-in period is reduced and the problems of housing wear in the inlet region are eliminated. Another advantage of the invention is that little contamination is generated in the event of bearing failure since a failure causes the gears to move into the clearance space on the low pressure side of the pump or motor. This movement causes the gears to move away from the sealing shoes on the high pressure side and pump flow will drop to zero. Another advantage is that worn pumps and motors which have not had bearing failures can be more readily repaired than heretofor. Gears, pressure plates and sealing shoes can be simply replaced, providing like-new performance at a cost well below the cost of a new pump.

Pumps and motors formed according to the invention are relatively insensitive to temperature changes. Since the clearance space between the radial sealing shoes and the gear teeth is dictated by the pressure plates on which the shoes are supported and since the pressure plates and the gears can and are desirably made of material having the same coefficient of expansion, such as steel, the clearance space remains constant despite wide variations in temperature even though the housing is made of material such as aluminum having a different coefficient of expansion.

It should be evident from the foregoing that the features of the invention described above are also applicable to gear motors of either the reversible or non-reversible type. In the case of a reversible motor floating shoes of the kind illustrated are provided on both sides of the gear elements.

What is claimed is:

1. In a pump or motor of the gear type wherein externally toothed drive and driven intermeshing gear elements are mounted for rotation about parallel axes, a housing forming a chamber within which the gears are mounted, said housing chamber having relieved wall portions at all points radially spaced from the tips of the teeth whereby the teeth are out of sealing relationship with said wall portions, separate passageways connected to said chamber on opposite sides of said gears, a pair of radial sealing members each having an arcuate sealing surface adjacent the gears and conforming to the path of the tips of the teeth, support means for said radial sealing members, said support means being seated in said housing for support thereby, said support means being disposed axially of said gears on opposite sides thereof for supporting said sealing members adjacent the said passageways having the higher pressure, for limiting movement of said arcuate surfaces to a position of sealing relationship with the tips of the teeth of said gears, means communicating said higher pressure to the surface of said sealing members opposite to the arcuate sealing surface whereby the sealing members are urged by said higher pressure towards the gear teeth, said support means being positioned to limit the extent of movement of said sealing members to a zero or oil film clearance with the tips of said gear teeth.

2. A pump or motor according to claim 1 wherein said sealing members are formed from a metallic material having characteristics which are different from the material of the housing.

3. In a pump or motor according to claim 2 wherein said sealing members comprise elements separate from the housing and formed from a material which is relatively more abrasion resistant than the housing material.

4. In a positive displacement pump of the gear type wherein a pair of toothed gear elements are mounted for rotation about axes spaced so that the gear elements are in mesh, a housing forming a chamber within which said gear elements are mounted, an inlet at one side of said gear elements for admission of fluid at low pressure, an outlet at the other side of said gear elements for discharge of fluid at high pressure, sealing means for providing a fluid seal between the low pressure inlet and the high pressure outlet comprising a pair of individually floating, solid, metallic radial sealing members adjacent the outlet, a recess within the housing for receiving said sealing members, said sealing members having an arcuate surface adjacent to the gears, said surface conforming to the path of the tips of the teeth to provide a fluid seal with the tip surfaces of the teeth adjacent to the fluid outlet, the interior of the housing being dimensioned to provide clearance between the teeth tips on the inlet side of said gear elements sufficient to provide a substantial clearance space between the teeth tips and the inlet side of the housing when the pump is under load, a passageway extending between said sealing members from the gears to the fluid outlet and means communicating the pump discharge pressure to the sides of said radial sealing members opposite to the gear teeth whereby the sealing members are urged by the discharge pressure into sealing relation with teeth adjacent the outlet, said sealing means further comprising side sealing plates within the chamber, said plates being spaced axially of the gears on opposite sides thereof and closely adjacent thereto for sealing the sides of the gears, said side sealing plates being supported by said housing, support surfaces on the edges of said side sealing plates adjacent the outlet providing for support of said sealing shoes, said support surfaces acting to limit movement of the shoes towards the gear teeth.

5. A pump according to claim 4 wherein the arcuate surfaces on said sealing members have a length sufficient to span no more than two of said gear teeth.

6. A pump according to claim 5, further comprising sealing strips extending lengthwise of the radial sealing members on the side of said members away from the gears, said sealing strips serving to confine the area of application of the discharge pressure.

7. A pump according to claim 6 further including a spacer between said radial sealing members.

8. A pump according to claim 7 wherein said radial sealing members are made of relatively highly abrasion resistant material.

* * * * *